US008182253B2

(12) United States Patent
Hirayama

(10) Patent No.: US 8,182,253 B2
(45) Date of Patent: May 22, 2012

(54) MULTI-CYLINDER ROTARY COMPRESSOR AND REFRIGERATION CYCLE EQUIPMENT

(75) Inventor: Takuya Hirayama, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 161 days.

(21) Appl. No.: 12/712,780

(22) Filed: Feb. 25, 2010

(65) Prior Publication Data

US 2010/0147013 A1 Jun. 17, 2010

Related U.S. Application Data

(63) Continuation of application No. PCT/JP2008/065461, filed on Aug. 28, 2008.

(30) Foreign Application Priority Data

Aug. 28, 2007 (JP) ..... 2007-221616

(51) Int. Cl.
*F01C 21/10* (2006.01)
*F03C 2/00* (2006.01)
*F03C 4/00* (2006.01)

(52) U.S. Cl. ..... 418/150; 418/11; 418/60

(58) Field of Classification Search ..... 418/11, 418/60, 63, 29, 30, 150
See application file for complete search history.

(56) References Cited

U.S. PATENT DOCUMENTS

| | | | | |
|---|---|---|---|---|
| 7,563,084 | B2 * | 7/2009 | Kurita et al. | 418/60 |
| 7,607,902 | B2 | 10/2009 | Onoda | |
| 2002/0104571 | A1 | 8/2002 | Hess et al. | |
| 2006/0002809 | A1 | 1/2006 | Kawabe et al. | |
| 2008/0112831 | A1 * | 5/2008 | Ogasawara et al. | 418/60 |

FOREIGN PATENT DOCUMENTS

| | | |
|---|---|---|
| CN | 1356476 | 7/2003 |
| CN | 1456813 | 11/2003 |
| DE | 68913045 E | 3/1994 |
| EP | 0428526 | 2/1994 |
| EP | 1605167 A1 | 12/2005 |
| EP | 1285188 | 1/2007 |
| JP | 55-48887 | 11/1980 |
| JP | 57-63986 | 4/1982 |
| JP | 57-165866 | 10/1982 |
| JP | 59-67619 | 5/1984 |

(Continued)

OTHER PUBLICATIONS

International Search Report issued in PCT/JP2008/065461 dated Nov. 25, 2008.

(Continued)

*Primary Examiner* — Theresa Trieu
(74) *Attorney, Agent, or Firm* — DLA Piper LLP US

(57) ABSTRACT

A rotary compressor, in which formulas Rc<Rm+e and RC≧Rs+e are established, when the radius of a main shaft is Rm, the radius of a countershaft is Rs, the radius of a crankshaft is Rc, and the eccentricity is e, a connecting part has a A-periphery which is formed on the counter-eccentric side periphery of the second crankshaft, and a B-periphery formed on the counter-eccentric side periphery of a first crankshaft, and a formula H>L≧H−Cr−Cs is established, when the axial direction of the connecting part is L, the axial length of the first roller is H, the axial length of a bevel formed at the inside edge of the first roller is Cr, and the axial direction of a bevel of the second crankshaft is Cs.

11 Claims, 14 Drawing Sheets

FOREIGN PATENT DOCUMENTS

| | | | | |
|---|---|---|---|---|
| JP | 62-195689 | | | 12/1987 |
| JP | 63-12689 | | | 1/1988 |
| JP | 63-45084 | | | 3/1988 |
| JP | 63-147983 | | | 6/1988 |
| JP | 64-0031273 | | | 2/1989 |
| JP | 03-019175 | | | 1/1991 |
| JP | 03-500080 | | | 1/1991 |
| JP | 5-47469 | | | 6/1993 |
| JP | 8-144976 | | | 6/1996 |
| JP | 9-79159 | | | 3/1997 |
| JP | 2000087888 | A | * | 3/2000 |
| JP | 2001099083 | A | * | 4/2001 |
| JP | 2002-138978 | | | 5/2002 |
| JP | 2002-181210 | | | 6/2002 |
| JP | 2003-328972 | | | 11/2003 |
| JP | 2003-533659 | | | 11/2003 |
| JP | 2004-124834 | | | 4/2004 |
| JP | 2004-301114 | A | | 10/2004 |
| JP | 2006-37893 | | | 2/2006 |
| JP | 2008-14150 | | | 1/2008 |
| JP | 2008-144587 | | | 6/2008 |
| KR | 2002-0034883 | | | 5/2002 |
| WO | WO 89/012552 | | | 12/1989 |
| WO | WO 01/88422 | | | 11/2001 |
| WO | WO-2004/083642 | A1 | | 9/2004 |

OTHER PUBLICATIONS

English Language Abstract of JP 2003-328972 Published Nov. 19, 2003.
Machine English Language Translation of JP 2003-328972 Published Nov. 19, 2003.
English Language Abstract of JP 55-048887 Published Apr. 8, 1980.
English Language Abstract of JP 2002-138978 Published May 17, 2002.
Machine English Language Translation of JP 2002-138978 Published May 17, 2002.
International Preliminary Report on Patentability issued in related international Application PCT/JP2008/065460 on Apr. 8, 2010.
international Preliminary Report on Patentability issued in related international Application PCT/JP2008/065461 on Apr. 8, 2010.
File History of U.S. Appl. No. 12/686,414.
English Abstract of JP 2003-533659 published Nov. 11, 2003.
File History of U.S. Appl. No. 12/953,731.
English Language Abstract of JP 2004-124834 published Apr. 22, 2004.
English Language Translation of JP 2004-124834 published Apr. 22, 2004.
International Search Report issued for PCT/JP2009/059719 on Jul. 7, 2009.
English Language Abstract of JP 2008-144587 published Jun. 26, 2008.
English Language Translation of JP 2008-144587 published Jun. 26, 2008.
English Language Abstract of JP 59-63986 published Apr. 16, 1982.
English Language Abstract of JP 63-45084 published Mar. 26, 1988.
English Language Abstract of JP 63-12689 published Jan. 12, 1988.
English Language Abstract of JP 59-67619 published May 8, 1984.
International Preliminary Report on Patentability and Written Opinion issued for PCT/JP2009/059719 on Jan. 20, 2011.
English Abstract of JP 64-031273 published Feb. 1, 1989.
English Abstract of JP 57-165866 published Oct. 13, 1982.
English Abstract of JP 2004-301114 published Oct. 28, 2004.
Machine translation of JP-2004-301114 A published Oct. 28, 2004.
English translation of WO-2004/083642 A1 published Sep. 30, 2004.
International Search Report of International Application No. PCT/JP2008/062831, mailed Oct. 14, 2008.
English language abstract of JP-2002-181210 published Jun. 26, 2002.
Machine English language translation of JP-2002-181210 published Jun. 26, 2002.
English language abstract of JP-03-019175 published Jan. 28, 1991.
Machine English language translation of JP-2003-533659 published Nov. 11, 2003.
English Abstract of EP 1285188 published Feb. 26, 2003.
English Language Abstract of CN Publication CN 1356476 published Jul. 3, 2002.
International Search report for PCT/JP2008/065460 issued Oct. 7, 2008.
English Language Abstract of JP 8-144976 published Jun. 4, 1996.
Machine English Language Translation of JP 8-144976 published Jun. 4, 1996.
English Language Abstract of JP 9-79159 published Mar. 25, 1997.
Machine English Language Translation of JP 9-79159 published Mar. 25, 1997.
English Language Abstract of JP 2008-14150 published Jan. 24, 2008.
Machine English Language Translation of JP 2008-14150 published Jan. 24, 2008.
English Language Abstract of JP 2006-037893 published Feb. 9, 2006.
Machine English Language Translation of JP 2006-037893 published Feb. 9, 2006.
Machine English Language Translation of JP 05-047469 published Jun. 25, 1993.
International Preliminary Report on Patentability issued in PCT/JP2008/062831 on Feb. 18, 2010.
File History of US Patent 7,607,902 issued Oct. 27, 2009.
File History of U.S. Appl. No. 12/712,875.
English Language Abstract of JP 57-63986 published Apr. 16, 1982.
English Language Abstract of JP 2000-087888 published Mar. 28, 2000.
English Language Translation of JP 2000-087888 published Mar. 28, 2000
English Language Abstract of JP 2001-099083 published on Apr. 10, 2001.
English Language Translation of JP 2001-099083 published on Apr. 10, 2001.
English Language Abstract of JP 63-147983 published Jun. 20, 1988.

* cited by examiner

MULTI-CYLINDER ROTARY COMPRESSOR AND REFRIGERATION CYCLE EQUIPMENT

CROSS-REFERENCE TO RELATED APPLICATIONS

This is a Continuation Application of PCT Application No. PCT/JP2008/065461, filed Aug. 28, 2008, which was published under PCT Article 21(2) in Japanese.

This application is based upon and claims the benefit of priority from prior Japanese Patent Application No. 2007-221616, filed Aug. 28, 2007, the entire contents of which are incorporated herein by reference.

BACKGROUND OF THE INVENTION

1. Field of the Invention

The present invention relates to a multi-cylinder rotary compressor provided with an improved compression mechanism, and refrigeration cycle equipment using the multi-cylinder rotary compressor for making a refrigeration cycle.

2. Description of the Related Art

Refrigeration cycle equipment comprising a refrigeration circuit uses various types of compressor. For example, an air-conditioner often uses a multi-cylinder rotary compressor, or a two-cylinder compressor. Such a type of compressor has a sealed case housing a motor unit and compressor mechanisms. The motor unit and compression mechanisms are connected through a rotary shaft.

In the above compression mechanism, a rotary shaft comprises a main shaft pivotally fixed to a main bearing, a countershaft pivotally fixed to a sub-bearing, crankshafts which are eccentrically provided between the main shaft and countershaft, fitted with rollers, and a connecting part connecting the crankshafts. The crankshafts and rollers are housed eccentrically rotatable in a cylinder chamber formed inside a cylinder.

In other words, two crankshafts are provided in the main shaft and countershaft. Two cylinders, having cylinder chambers for housing the crankshafts and rollers, are provided. An intermediate partition board is inserted between the cylinders. The connecting part provided between the crankshafts faces the intermediate partition board.

In a multi-cylinder rotary compressor, it is desirable to decrease the diameter of a crankshaft, which is the largest in the sliding part of a rotary shaft, decrease friction loss, and increase efficiency. At the same time, it is recommendable to decrease the height (axial length) of a cylinder, and increase the eccentricity of a crankshaft, in order to decrease sliding loss.

Usually, the main shaft and countershaft forming the above rotary shaft are formed to have the same radius Rm. Assuming the radius of the crankshaft to be Rc and the eccentricity of the crankshaft to be 2, the following formula is established. The diameters of the crankshaft and cylinder chamber can be decreased, and the above advantageous condition can be obtained.

$$Rc<Rm+e$$

The problem is the axial length L of the connecting part provided between the crankshafts, and the axial length H (cylinder thickness) of the roller fitted to the crankshaft, which are necessary for fitting the roller to the crankshaft. For example, the axial length L of the connecting part is set smaller than the axial length H of the roller (L<H).

In this case, according to the above relationship (L<H), even if the roller can be inserted from the end face of the countershaft and the connecting part can be connected to the crankshaft provided in the countershaft, when the inserted end face of the roller contacts the end face of the crankshaft provided in the main shaft, the other end face of the roller opposite to the inserted end is positioned oppositely to the crankshaft provided in the countershaft. In other words, the inserted end face of the roller contacts the end face of the crankshaft of the main shaft before the roller does not completely come out of the crankshaft of the countershaft, and the roller cannot be fitted to the crankshaft of the main shaft.

Jpn. Pat. Appln. KOKAI Publication No. 2003-328972 discloses a technique of decreasing the diameter of a countershaft to be smaller than a main shaft, contracting the outer periphery of the side opposite to an eccentric shaft in the crankshaft, from the outer periphery of the main shaft, providing a part having a diameter smaller than the outside diameter of the main shaft in a connecting part (a joint), and making the axial length of the small diameter part greater than the axial length of the roller fitted to the crankshaft of the main shaft.

Jpn. UM Appln. KOKOKU Publication No. 55-48887 discloses a crankshaft comprising a columnar part in which a connecting part formed between adjacent crankshafts (crankpins) is concentric with a rotary shaft line, and smaller than the outside diameter of the crankshaft; and a connecting wall part which is formed on both end faces of the columnar part, and has a cross section which is overlapped when the columnar part and crankshaft are overlapped in the axial direction of the rotary shaft.

BRIEF SUMMARY OF THE INVENTION

According the technique disclosed in Jpn. Pat. Appln. KOKAI Publication No. 2003-328972, a configuration expressed by the above formula Rc<Rm+e is possible, and it is possible to insert a roller from the end face of a countershaft, pass over a crankshaft provided in the countershaft, and fitted to the crankshaft of the main shaft after once placing in a connecting part. Thereafter, another roller is fitted to the crankshaft of the countershaft. This facilitates the assembling work.

However, in the technique disclosed in Jpn. Pat. Appln. KOKAI Publication No. 2003-328972, it is necessary to provide a part having smaller diameter than the main shaft in the connecting part between the crankshafts of the main shaft and countershaft, and to make the axial length of the part greater than that of the roller fitted to the crankshaft of the main shaft.

Therefore, particularly when the axial length of the roller fitted to the crankshaft of the main shaft is greater, it is necessary to provide a connecting part whose axial length is greater than that of the roller, and the distance between the crankshafts becomes large. This decreases the rigidity of the connecting part, and causes a problem in the reliability and performance.

On the other hand, in the technique described in Jpn. UM Appln. KOKOKU Publication No. 55-48887, the cross-sectional area of the connecting part can be made greater than that in the prior art, and the rigidity is improved. However, in this technique, a large diameter part of a connecting rod is connected to a crankshaft, and the axial length (thickness) of the large diameter part is made less than that of the connecting part.

Therefore, no problem arises when the large diameter part of the connecting rod is connected to the crankshaft. However, as described above, considering the configuration of fitting the roller to the crankshaft, the axial length L of the connecting part is made greater than or equal to (LH) the axial length H of the roller (crankshaft), and a problem arises in the rigidity of the connecting part.

The invention has been performed in the above circumstances. It is an object of the invention to provide a multi-cylinder rotary comprising two or more compression mechanisms, in which a roller to be fitted to a crankshaft of a main shaft is inserted from the direction of the end face of a countershaft, the crankshaft diameter is decreased as much as possible to reduce sliding loss, the axial length of a connecting part, which is the distance between the crankshafts, is reduced, and the compression mechanism is made compact, thereby the compression performance and reliability are improved, and refrigeration cycle equipment which comprises the multi-cylinder rotary compressor for improving refrigeration efficiency and reliability.

In order to satisfy the object, a multi-cylinder rotary compressor of the present invention comprises a rotary shaft which comprises a main shaft pivotally fixed to a main bearing, a countershaft pivotally fixed to a sub-bearing, crankshafts provided eccentrically between the main shaft and countershaft, and fitted with rollers, and a connecting part connecting adjacent crankshafts; and cylinder chambers which house the crankshafts and rollers of the rotary shaft in being eccentrically rotatable, wherein formulas (1) and (2) are established, assuming the radius of the main shaft of the rotary shaft to be Rm, the radius of the countershaft to be Rs, the radius of the crankshaft to be Rc, and the eccentricity of the crankshaft to be e, $$Rc<Rm+e \quad (1)$$

$$Rc\geqq Rs+e \quad (2)$$

the connecting part which connects a first crankshaft provided in the main shaft and a second crankshaft provided in the countershaft, comprises:

an A-periphery, which is positioned on the same level as the outer periphery of the second crankshaft, or inside the outer periphery, on the counter-eccentric side periphery of the second crankshaft 4*d*, and has a radius greater than the radius Rs of the countershaft; and a B-periphery, which is positioned on the same level as the outer periphery of the first crankshaft, or inside the outer periphery, on the counter-eccentric side periphery of the first crankshaft, and has a radius greater than the radius Rs of the countershaft, and a formula (3) is established, assuming the axial length of the connecting part to be L, the axial length of the roller fitted to the first crankshaft to be H, the axial length of a bevel formed at the inside peripheral edge of the roller fitted to the first crankshaft to be Cr, and the axial length of a bevel formed in the second crankshaft to be Cs, $$H>L\geqq H-Cr-Cs \quad (3)$$

In order to satisfy the object, refrigeration cycle equipment of the present invention comprises above multi-cylinder rotary compressor, a condenser, an expansion device, and an evaporator.

DETAILED DESCRIPTION OF THE INVENTION

Figure 1:
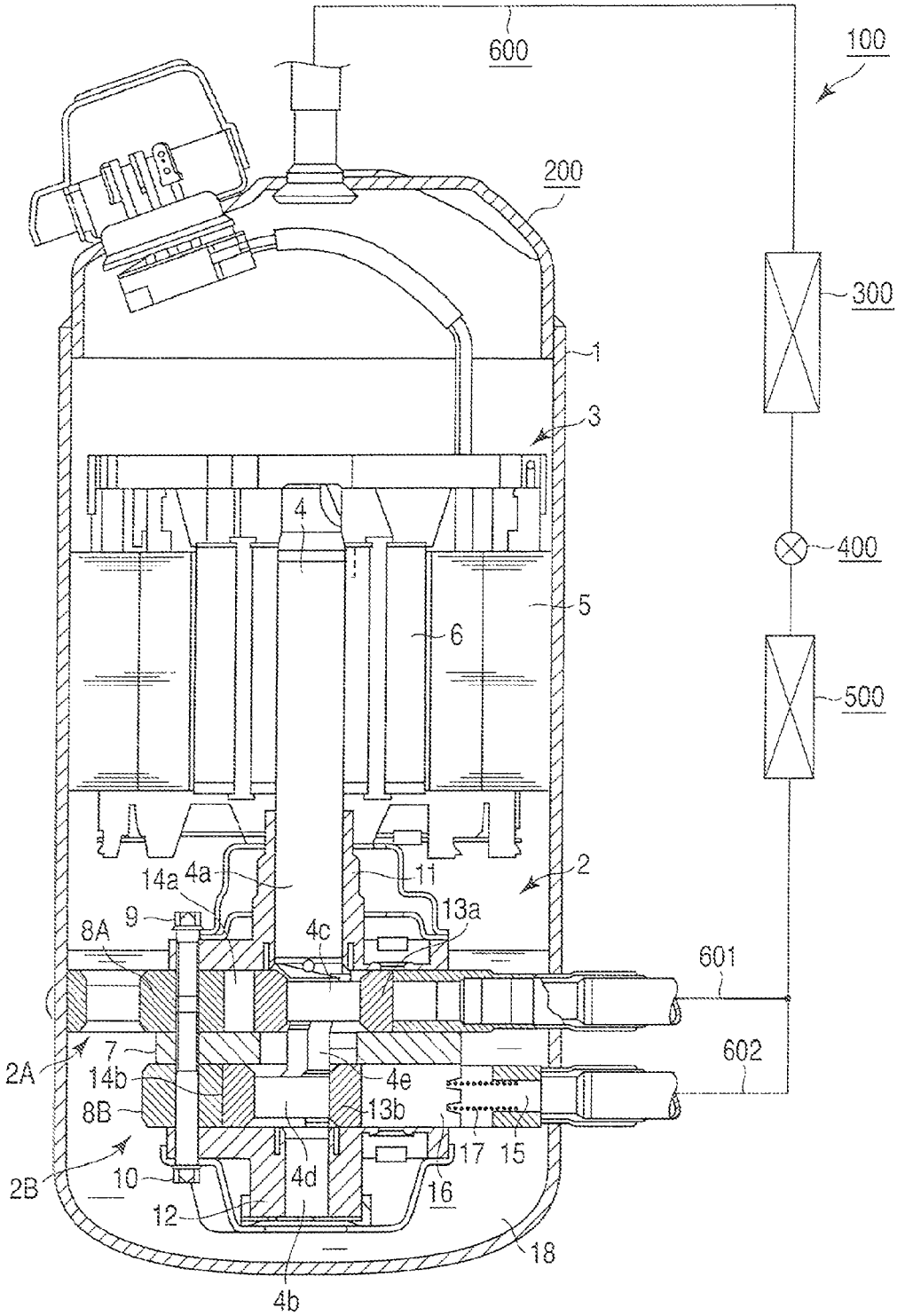
FIG. 1 is an outline sectional view of a multi-cylinder rotary compressor, and a refrigeration cycle of refrigeration cycle equipment, according to a first embodiment of the invention.

Embodiments of the invention will be explained hereinafter with reference to the accompanying drawings. FIG. 1 shows a sectional view of a structure of a multi-cylinder rotary compressor 200 according to a first embodiment of the invention, and an outline block diagram of refrigeration cycle equipment R comprising the multi-cylinder rotary compressor 200.

First, a configuration of the refrigeration equipment R will be explained. The refrigeration equipment R comprises a multi-cylinder rotary compressor 200, a condenser 300, an expansion device 400, an evaporator 500, and a not-shown gas-liquid separator. These components are sequentially communicated through a refrigerant pipe 600. As described later, refrigerant gas compressed by the multi-cylinder rotary compressor 200 is discharged to the refrigerant pipe 600, circulated through the above components, forming a refrigeration cycle, and fed back to the multi-cylinder rotary compressor 200.

Next, the multi-cylinder rotary compressor 200 will be described in detail.

Reference number 1 in FIG. 1 denotes a sealed case. A compression mechanism 2 is provided in the lower part of the sealed case 1, and a motor unit 3 is provided in the upper part. The compression mechanism 2 and motor unit 3 are connected through a rotary shaft 4.

The motor unit 3 uses a brushless synchronous motor (an AC motor or commercial power motor), for example, and comprises a stator 5 which is press fitted to the interior of the sealed case 1, and a rotor 6 which is provided inside the stator 5 with a predetermined clearance, and fitted to the rotary shaft 4.

The compression mechanism 2 comprises a first compression mechanism 2A, and a second compression mechanism 2B. The first compression mechanism 2A is provided in the upper part of the sealed case, and comprises a first cylinder 8A. The second compression mechanism 2B is formed in the lower part under the first cylinder 8A through an intermediate partition board 7, and comprises a second cylinder 8B.

The first cylinder 8A is press fitted to the inside of the sealed case 1. A main bearing 11 is provided on the upper surface of the first cylinder 8A. The main bearing 11 and valve cover are fixed to the first cylinder 8A by a fixing bolt 9. A sub-bearing 12 and valve cover are stacked on the lower surface of the second cylinder 8B, and fixed to the first cylinder 8A by a fixing bolt 10 through the intermediate partition board 7.

A part pivotally fixed to the main bearing 11 is called a main shaft 4*a*, and a part pivotally fixed to the sub-bearing 12 that is the lowermost end of the rotary shaft 4 is called a countershaft 4*b*. A first crankshaft 4*c* is provided at a position penetrating the inside of the first cylinder 8A of the rotary shaft 4 in one piece with the first cylinder. A second crankshaft 4*d* is provided at a position penetrating the interior of the second cylinder 8B in one piece with the second cylinder.

In other words, the first crankshaft 4*c* is provided in the main shaft 4*a*, and the second crankshaft 4*d* is provided in the countershaft 4*b*. A connecting part 4*e* is inserted between the crankshafts 4*c* and 4*d*, and faced to the intermediate partition board 7. The shapes and dimensions of the connecting part 4*e* and surrounding parts will be described later.

The crankshafts 4*c* and 4*d* are formed with a phase difference of about 180°, in being displaced by the same distance from the center axes of the main shaft 4*a* and countershaft 4*b* of the rotary shaft 4, having the same diameter. The inside diameter part of the first roller 13*a* is fitted to the first crankshaft 4*c*, and the inside diameter part of the second roller 13*b* is fitted to the second crankshaft 4*d*. The first and second rollers 13*a* and 13*b* are formed to have the same outside diameter.

The inside peripheries of the first and second cylinders 8A and 8*b* are separated into upper and lower parts by the main bearing 11, intermediate partition board 7, and sub-bearing 12. The first roller 13*a* and first crankshaft 4*c* are housed eccentrically rotatable in a first cylinder chamber 14*a* separated by the above members. The second roller 13*b* and second crankshaft 4*d* are housed eccentrically rotatable in a second cylinder chamber 14*b* separated by the above members.

The first and second rollers 13*a* and 13*b* are formed with a phase difference of 180°; but designed to have a part of the A-periphery along the axial direction of the rollers 13*a* and 13*b* eccentrically rotatable while making line contact with the peripheral walls of the cylinder chambers 14*a* and 14*b*.

Blade chambers are provided in the first and second cylinders 8A and 8B. Each blade chamber contains a blade 16 and a spring member 17 (shown only in one of them). The spring member 17 is a compression spring, which applies elastic force (back pressure) to the blade 16, and makes its front end line contacting along the axial direction of the peripheral surface of the rollers 13*a* and 13*b*.

Therefore, the blade 16 reciprocates along the blade chamber 15, and divides the cylinder chambers 14*a* and 14*b* into two compartments regardless of the rotation angles of the first and second rollers 13*a* and 13*b*.

A discharge valve mechanism is provided in the main bearing 11 and sub-bearing 12. Each discharge valve mechanism communicates with the cylinder chambers 14*a* and 14*b*, and is covered with a valve cover. As described later, the discharge valve mechanism is opened when the pressure of the refrigerant gas compressed in the cylinder chambers 14*a* and 14*b* is increased to a predetermined value. The compressed refrigerant gas is discharged from the cylinder chambers 14*a* and 14*b* into the valve cover through the discharge valve mechanism, and led to the sealed case 1.

A suction hole is provided in the area from the outer periphery to the inside diameter part of the first cylinder 8A, penetrating the sealed case 1. The suction hole is connected to a refrigerant pipe 601 communicating with the evaporator 500 from the gas-liquid separator. Another suction hole is provided in the area from the outer periphery to the inside diameter part of the second cylinder 8B, penetrating the sealed case 1. The suction hole is connected to a refrigerant pipe 602 communicating with the gas-liquid separator from the evaporator 500.

An oil sump 18 to collect lubricant is formed at the inside bottom of the sealed case 1. The entire second compression mechanism 2B and most parts of the first compression mechanism 2A are immersed in lubricant. As the rotary shaft 4 is rotated, an oil pump provided on the end face of the countershaft 4*b* absorbs and supplies lubricant to the sliding area of the parts constituting the compression mechanism 2.

In the multi-cylinder rotary compressor 200 configured as above, when the motor unit 3 is energized, the rotary shaft 4 is rotated, the first roller 13*a* is eccentrically moved in the first cylinder chamber 14*a*, and the second roller 13*b* is eccentrically moved in the second cylinder chamber 14*b*. The refrigerant gas separated by the gas-liquid separator is drawn into one of the chambers separated by the blade 16 in each cylinder chamber 14*a* and 14*b* and provided with a suction hole, through the suction refrigerant pipes 601 and 602 of the suction side.

As the first and second crankshafts 4*c* and 4*d* fixed to the rotary shaft 4 are formed to have a phase difference of 180°, the same phase difference 180° occurs at the time of drawing the refrigerant gas into the cylinder chambers 14*a* and 14*b*. When the first and second rollers 13*a* and 13*b* are eccentrically moved, the capacity of the chamber close to the discharge valve mechanism is decreased, and the pressure is increased by the amount equivalent to the decreased capacity.

When the capacity of the chamber close to the discharge valve mechanism reaches a predetermined value, the refrigerant gas compressed in this chamber is increased to a predetermined pressure. At the same time, the discharge valve mechanism is opened, and the compressed high-temperature high-pressure refrigerant gas is discharged into the valve cover. A phase difference of 180° occurs at the time of discharging the compressed refrigerant gas to the discharge valve mechanism.

The compressed refrigerant gas is directly or indirectly led to the space between the compression mechanism 2 and motor unit 3 in the sealed case 1. The compressed refrigerant gas is flowed through the clearances between the rotary shaft 4 and rotor 6 forming the motor unit 3, between the rotor and stator 5, and between the stator 5 and the inner peripheral wall of the sealed case 1, and is filled in the space in the sealed case 1 formed above the motor unit 3.

The compressed refrigerant gas is sent from the multi-cylinder rotary compressor 200 to the refrigerant pipe 600, led to the condenser 300 and condensed, and led to the expansion device 400 and adiabatically expanded, and led to the evaporator and evaporated, releasing latent heat from the surrounding area, and producing the refrigeration effect. The evaporated refrigerant is led to the gas-liquid separator and separated into gas and liquid, and only the gas component is drawn into the compression mechanism 2 of the multi-cylinder rotary compressor 200, and compressed again.

Next, a detailed explanation will be given of the shapes and dimensions of the connecting part 4*e* constituting the rotary shaft 4, and the surrounding parts.

Figure 2A:
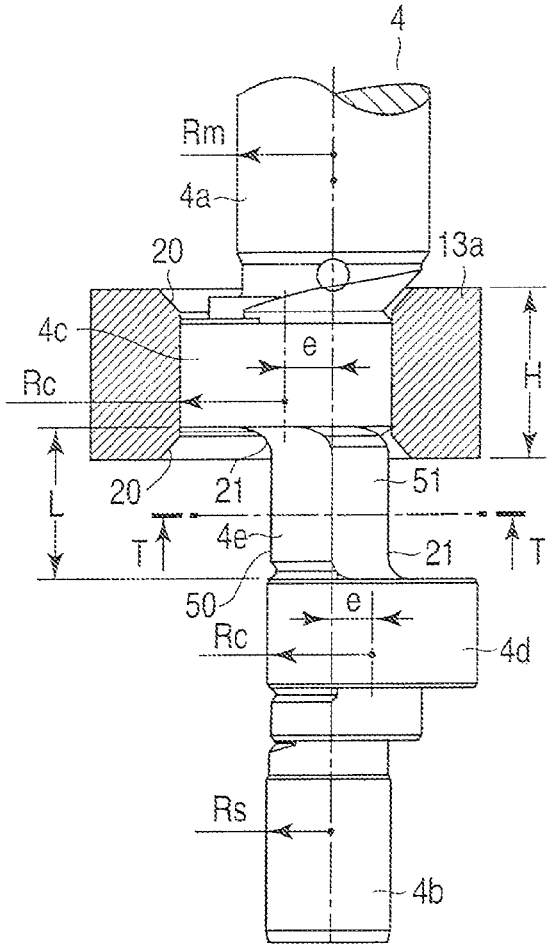
FIG. 2A is a sectional view showing the shapes, dimensions, and configurations of a first roller and a part of a rotary shaft of the multi-cylinder rotary compressor.
Figure 2B:
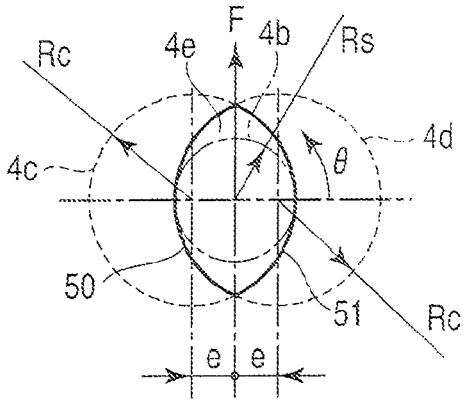
FIG. 2B is a sectional view of a part of the rotary shaft of the multi-cylinder rotary compressor taken along line T-T.

FIG. 2A shows a part of the rotary shaft 4 close to the compression mechanism 2, and the configuration of the first roller 13*a*. FIG. 2B is a sectional view taken along line T-T of FIG. 2A.

If the compressor is configured to have the following equation (1), assuming that the radius of the main shaft 4*a* constituting the rotary shaft 4 is Rm, the radius of the countershaft 4*b* is Rs, the radius of each first and second crankshaft 4*c* and 4*d* is Rc, and the eccentricity of each crankshaft 4*c* and 4*d* is e, $$Rc<Rm+e \quad (1)$$

the diameters of the first and second crankshafts 4*c* and 4*d*, and the first and second cylinder chambers 14*a* and 14*b* are reduced, and friction loss can be decreased, and compression efficiency can be improved.

If the compressor is configured to have the following equation (2), $$Rc\geqq Rs+e \quad (2)$$

the first roller 13*a* can be inserted from the end face of the countershaft 4*b*, and passed through the second crankshaft 4*d*. Therefore, finally, the first roller can be fitted to the first crankshaft 4*c*.

In the state shown in the drawing, it is confirmed that the center axis line of the first crankshaft 4*c* is displaced to the left side from the center axis lines of the main shaft 4*a* and countershaft 4*b*, and the center axis line of the second crankshaft 4*d* is displaced to the right side from the center axis lines of the main shaft 4*a* and countershaft 4*b*. The following configuration is based on the above confirmation.

The connecting part 4*e* connecting the first crankshaft 4*c* and second crankshaft 4*d* are particularly formed to have a cross section indicated by a solid line in FIG. 2 (hatching is omitted to simplify the drawing).

In other words, in FIG. 2B, when the vertical center axis line and the horizontal center axis line intersecting the vertical center axis line are drawn, an intersection point of the vertical and horizontal center lines coincides with the center axis line of the main shaft 4*a* and countershaft 4*b*. The cross section of the connecting part 4*e* is arc-shaped and bilaterally symmetrical along the vertical center line.

Further, in the cross-sectional shape of the connecting part 4*e*, the left side arc-shaped part along the vertical center line is a periphery of the counter-eccentric side of the second crankshaft 4*d*, which is hereinafter called an A-periphery 50. The right side arc-shaped part is a periphery of the counter-eccentric side of the first crankshaft 4*c*, which is hereinafter called a B-periphery 51.

The above A-periphery 50 is formed on the same level as the outer periphery of the second crankshaft 4*d*, or inside the outer periphery, and is arc-shaped with a radius greater than the radius Rs of the countershaft 4*b*.

The above B-periphery 51 is formed at the same level as the outer periphery of the first crankshaft 4*c*, or inside the outer periphery, and is arc-shaped with a radius greater than the radius Rs of the countershaft 4*b*.

Therefore, the cross section of the connecting part 4*e* is shaped to be thickest along the vertical center axis line. For example, assuming the horizontal center axis line θ to be 0°, the thickness is maximum at the position of θ=90°.

The connecting part 4*e* is formed to have the above cross section. Assuming the axial length of the connecting part 4*e* to be L, and the length of the first roller 13*a* fitted to the first crankshaft 4*c* provided in the main shaft 4*a* to be H, the axial length H of the first roller 13*a* is set to be greater than the axial length L of the connecting part 4*e* (H>L). A bevel 20 cut by predetermined amount is formed at both inside edges of the first roller 13*a*.

When refrigerant gas is compressed in the multi-cylinder rotary compressor 200 adopting the rotary shaft 4 satisfying the above conditions, gas load is applied to the rotary shat 4 as described below.

Figure 3:
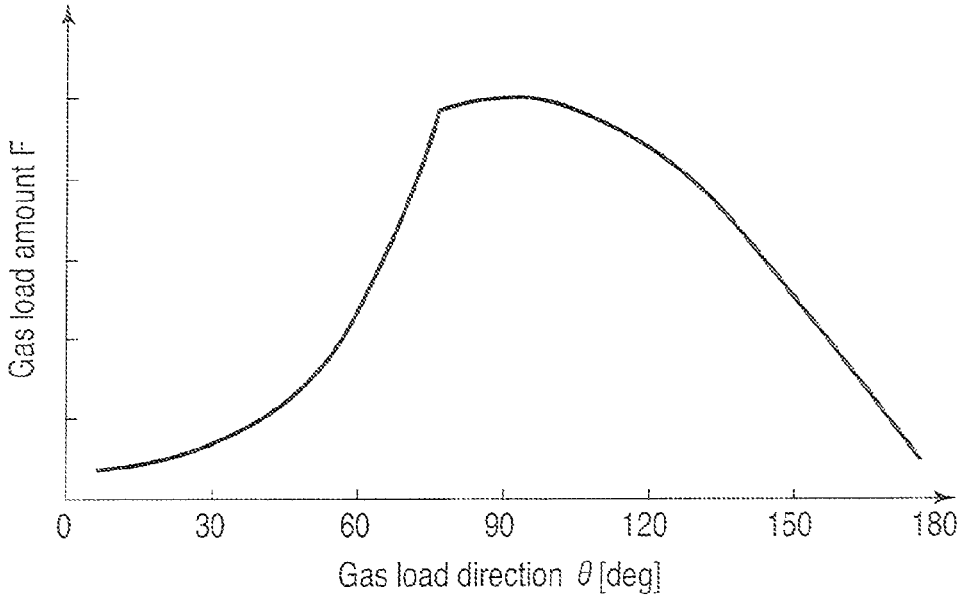
FIG. 3 is a graph showing the direction and amount of gas load in the multi-cylinder rotary compressor.

FIG. 3 is a graph showing the relationship between the direction θ [deg] and amount F of gas load applied to the first crankshaft 4*c* in the multi-cylinder rotary compressor.

As seen from the graph, if the direction of gas load applied to the first crankshaft 4*c* is expressed on the basis of θ shown in FIG. 2B, the amount of gas load F is maximum when 0 is about 90°. As described above, the connecting part 4*e* is thickest in the part where θ=90° along the vertical center axis line, and the rigidity is increased, and the connecting part 4*e* is prevented from being deformed by the gas load.

Jpn. UM Appln. KOKOKU Publication No. 55-48887 describes that sufficient rigidity is not obtained in a connecting part formed between crankshafts, which is formed by connecting the outer peripheral arcs of counter-eccentric sides. This is true for a reciprocating type compressor, in which a maximum load is likely to be applied to the thinnest portion of a connecting part. In contrast, in a rotary compressor according to the present invention, a direction of maximum load coincides with a thickest portion of the connecting part 4*e*, and the configuration of the connecting part is effective.

The axial length H of the first roller 13*a* is set to be greater than the axial length L of the connecting part 4*e* (H>L). In other words, the axial length L of the connecting part 4*e* is reduced, and the rigidity of the connecting part 4*e* is increased furthermore.

On the other hand, when the first roller 13*a* is fitted to the crankshaft 4*c*, the axial length H of the first roller 13*a* is greater than the axial length L of the connecting part 4*e* when the first roller 13*a* is inserted onto the connecting part 4*e* from the direction of the counter shaft 4*b*, and it is difficult to move the first roller 13*a* from the connecting part 4*e* to the first crankshaft 4*c* in this state.

However, as described above, the first roller 13*a* has the bevel 20 at both inside edges, and the first roller can be easily fit to the first crankshaft 4*c* by changing the insertion direction when the end face of the insertion side reaches the first crankshaft 4*c*. In other words, the first roller 13*a* can be easily and stably fitted to the first crankshaft 4*c*.

Further, as shown in FIG. 2A, as a raised portion (R-portion) 21 is formed at the corners of the first crankshaft 4*c* on the A-periphery and second crankshaft 4*d* on the B-periphery, the rigidity of the base part of the connecting part 4*e* can be increased without damaging the function and effect described above, and the rigidity of the connecting part 4*e* can be kept high.

Hereinafter, the work of fitting the first roller 13*a* to the crankshaft 4*c* will be explained in detail.

FIGS. 4A to 4D are diagrams explaining the work of fitting the first roller 13*a* to the first crankshaft 4*c*.

Figure 4A:
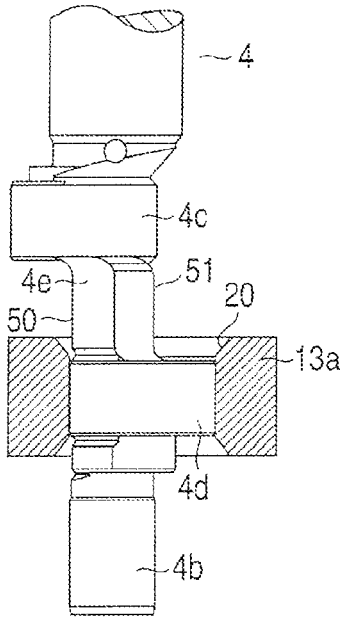
FIG. 4A is an explanatory diagram showing steps from insertion of a first roller of the multi-cylinder rotary compressor from the direction of a countershaft, to fitting the roller to a first crankshaft.

In FIG. 4A, the first roller 13*a* inserted from the end face of the countershaft 4*b* is moved and fitted to the second crankshaft 4*d*. As the bevel 20 is formed at both inside edges of the first roller 13*a*, the first roller 13*a* can be smoothly fitted to the second crankshaft 4*d*. Therefore, the first roller 13*a* can be moved up furthermore, and reaches the connecting part 4*e*.

Figure 4B:
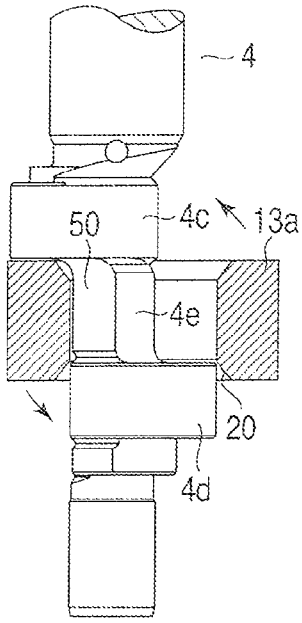
FIG. 4B is an explanatory diagram showing steps from insertion of a first roller of the multi-cylinder rotary compressor from the direction of a countershaft, to fitting the roller to a first crankshaft.

In FIG. 4B, the first roller 13*a* is moved to the connecting part 4*e*. The A-periphery 50 of the connecting part 4*e* is positioned on the same level as the outer periphery of the second crankshaft 4*d*, or inside the outer periphery. Therefore, the first roller 13*a* can be easily smoothly moved from the second crankshaft 4*d* to the connecting part 42, so that the inside diameter part of the first roller 13*a* is faced to the A-periphery 50 of the connecting part 4*e*.

In this state, the end face of the insertion side (upper end face) of the first roller 13*a* contacts the lower end face of the first crankshaft 4*c*. Further, as the axial length H of the first roller is set to be greater than the axial length of the connecting part 4*e*, the lower end face of the first roller 13*a* is positioned under the lower end of the connecting part 4*e*.

In this state, it is difficult to move the first roller 13*a* so that the inside diameter part is faced to the first crankshaft 4*c*. However, as indicated by an arrow, the first roller 13*a* is inclined in the counterclockwise direction, and moved in parallel to the left side in the drawing. The bevels 20 formed at both inside edges of the first roller 13*a* contact, and ride over the edges of the second crankshaft 4*d*.

The first roller 13*a* is moved and energized, and the lower end face of the first roller is placed on the upper end face of the second crankshaft 4*d*. A part of the inside diameter part of the first roller 13*a* is smoothly inserted into a part of the lower end of the first crankshaft 4*c*.

Figure 4C:
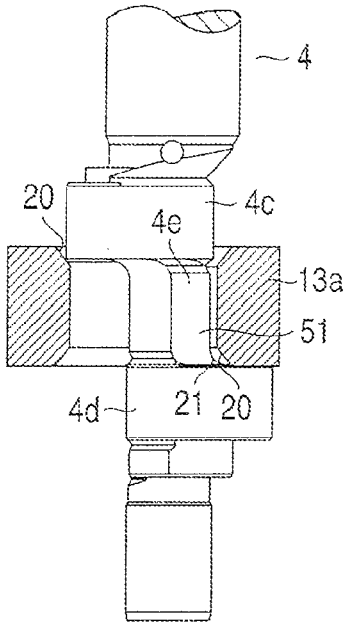
FIG. 4C is an explanatory diagram showing steps from insertion of a first roller of the multi-cylinder rotary compressor from a countershaft, to fitting the roller to a first crankshaft.

As shown in FIG. 4C, the inside diameter part of the first roller 13*a* faces, contacts, or comes close to the first crankshaft 4*c*. The lower end face of the first roller 13*a* is placed on the upper end face of the second crankshaft 4*d*, and the inside diameter part of the first roller contacts, or come close to the B-periphery 51 of the connecting part 4*e*. The raised portion 21 formed at the lower end of the B-periphery 51 of the connecting part 4*e* is placed under the bevel 20 at the lower inside edge of the first roller 13*a*, and the first roller 13*a* is correctly faced to the first crankshaft 4*c*.

Figure 4D:
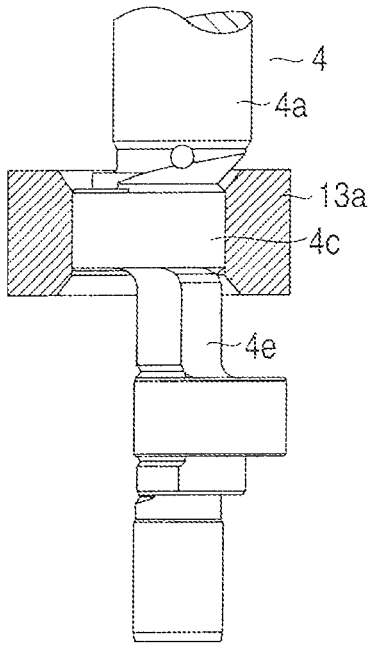
FIG. 4D is an explanatory diagram showing steps from insertion of a first roller of the multi-cylinder rotary compressor from a countershaft, to fitting the roller to a first crankshaft.

As shown in FIG. 4D, if the first roller 13 is moved immediately upward, the inside diameter part of the first roller 13*a* is fitted to the first crankshaft 4*c*.

As the axial length H of the first roller 13*a* is made greater than the axial length L of the connecting part 4*e* (H>L), the connecting part 4*e* is reduced in length and increased in rigidity. As the bevel 20 is formed in the connecting part 4*e*, the first roller is easily fitted to the first crankshaft 4*c* from the direction of the countershaft 4*b* through the connecting part 4*e*.

Figure 5:
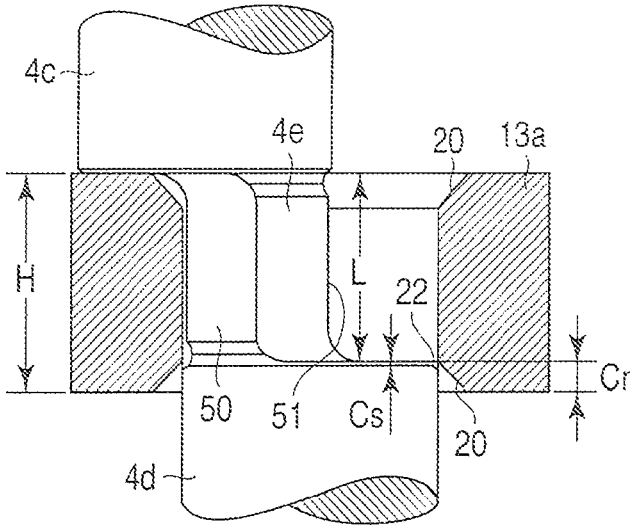
FIG. 5 is an explanatory diagram showing the shapes and dimensions of a connecting part and a first roller of the multi-cylinder rotary compressor, in the state in which the first roller is being in the connecting part.

In FIG. 5, the first roller 13*a* is moved to the connecting part 4*e*. Here, the above configuration is adopted, the bevel 22 is formed along the upper peripheral edge of the second crankshaft 4*d*.

Assuming the axial length of the connecting part 4*e* to be L, the axial length of the first roller 13*a* fitted to the first crankshaft 4*c* provided in the main shaft 4*a* to be H, the axial length of the bevel 20 formed at the inside peripheral edge of the first roller 13*a* to be Cr, and the axial length of a bevel 22 formed at the upper peripheral edge of the second crankshaft 4*d* to be Cs, the relationship of H>L is as described above.

$$L+Cs \geqq H-Cr$$

$$L \geqq H-Cr-Cs$$

$$H>L \geqq H-Cr-Cs \tag{3}$$

Further, the connecting part is configured to meet the above formula (3).

As described above, though the axial length L of the connecting part 4*e* is made less than the axial length H of the first roller 13*a*, a bevel 20 is formed in the first roller 13*a*, and a bevel 22 is formed in the second crankshaft 4*d*. This facilitates the work of fitting the first roller 13*a* to the first crankshaft 4*c* through the countershaft 4*b* and second crankshaft 4*d*.

Figure 6:
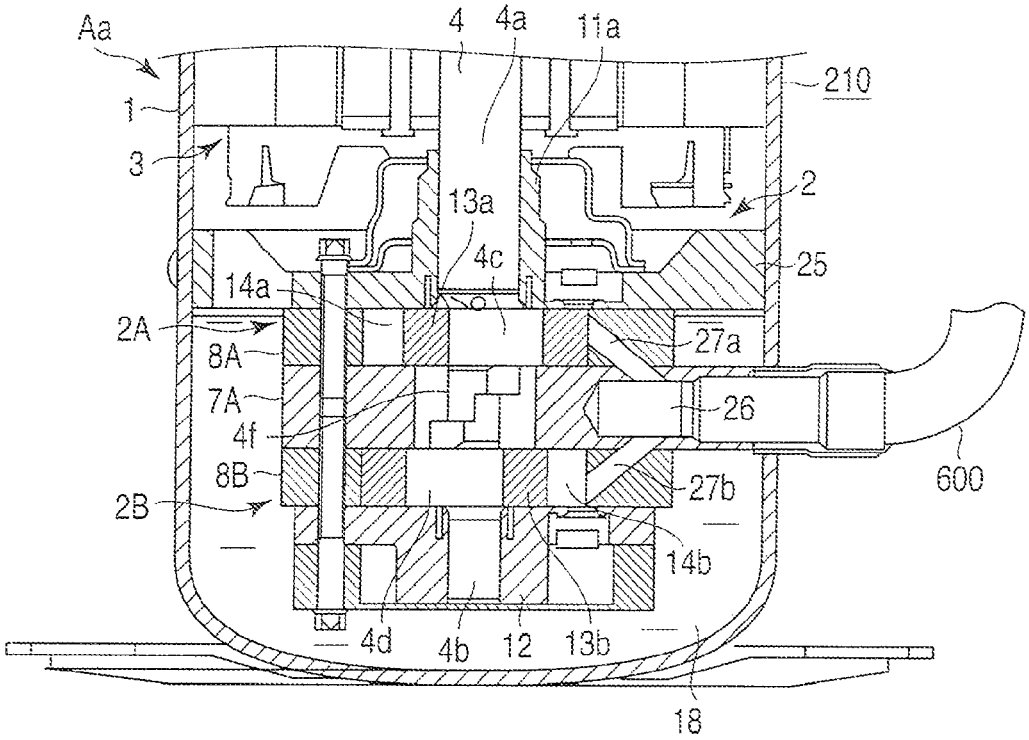
FIG. 6 is an outline sectional view of a multi-cylinder rotary compressor, omitted in some parts, according to a second embodiment of the invention.

FIG. 6 is a sectional view of a part of a multi-cylinder rotary compressor 210 according to a second embodiment.

In the compressor 210, as in the first embodiment, first and second compression mechanisms 2A and 2B are connected together with a motor unit 3 through a rotary shaft 4, and housed in a sealed case 1. The configuration of the motor unit 3 is the same as that in the first embodiment. The first and second compression mechanisms 2A and 2B are basically the same as those in the first embodiment. Main components are denoted by the same reference numbers, and an explanation thereof is omitted.

In the compression mechanism 2, a main bearing 11*a* is formed in one piece with a frame 25 press fitted to the sealed case 1, and a first cylinder 8A is fixed to the lower surface of the frame 26. An intermediate partition board 7A is made thick. A suction hole 26 is formed penetrating a part of the sealed case 1 and the outer periphery of the intermediate partition board 7A.

The suction hole 26 is connected to a refrigerant pipe 600 of the suction side through an evaporator 500 and a gas-liquid separator. In the first embodiment, two refrigerant pipes 601, Pb are connected. However, in the second embodiment, only one refrigerant pipe 600 is connected.

The suction hole 26 is formed in the area from the outer periphery of the intermediate partition board 7A to the mid portion before the inside diameter part. Suction guide holes 27*a* and 27*b* are formed obliquely upward and downward from the end.

The suction guide hole 27*a* is provided obliquely upward from the lower surface of the first cylinder 8A, and opened to a first cylinder chamber 14*a* that is the inside diameter part of the cylinder. The suction guide hole 27*b* is extended obliquely downward from the upper surface of the second cylinder 8B, and opened to a second cylinder chamber 14*b* that is the inside diameter part of the cylinder.

Therefore, refrigerant gas is led to the suction hole 26 formed in the intermediate separation plate 7A through one refrigerant pipe 600, divided into two suction guide holes 27*a* and 27*b*, and drawn into the first and second cylinder chambers 14*a* and 14*b*.

In the multi-cylinder rotary compressor 210 configured as above, the intermediate partition board 7A is thicker than the intermediate partition board 7 in the first embodiment, but the thickness of the first and second cylinders 8A and 8B are basically unchanged.

In other words, the axial lengths of the first crankshaft 4*c* and first roller 13*a* housed in the first cylinder chamber 14*a*, and the axial lengths of the second crankshaft 4*d* and second roller 13*b* housed in the second cylinder chamber 14*b*, are unchanged, but the axial length of the connecting part 4*f* facing the intermediate partition board 7A and connecting the first and second crankshafts 4*c* and 4*d* is greater than that of the connecting part 4*e* in the first embodiment.

Further, as the gas load applied to the connecting part 4*f* is unchanged, the rigidity of the connecting part 4*f* is not ensured in this configuration. Therefore, a configuration described hereinafter is adopted to improve the rigidity of the connecting part 4*f*, prevent deformation, and improve the reliability.

The shapes and dimensions of connecting part 4*f* constituting the rotary shaft 4 and peripheral parts will be described in detail hereinafter.

Figure 7A:
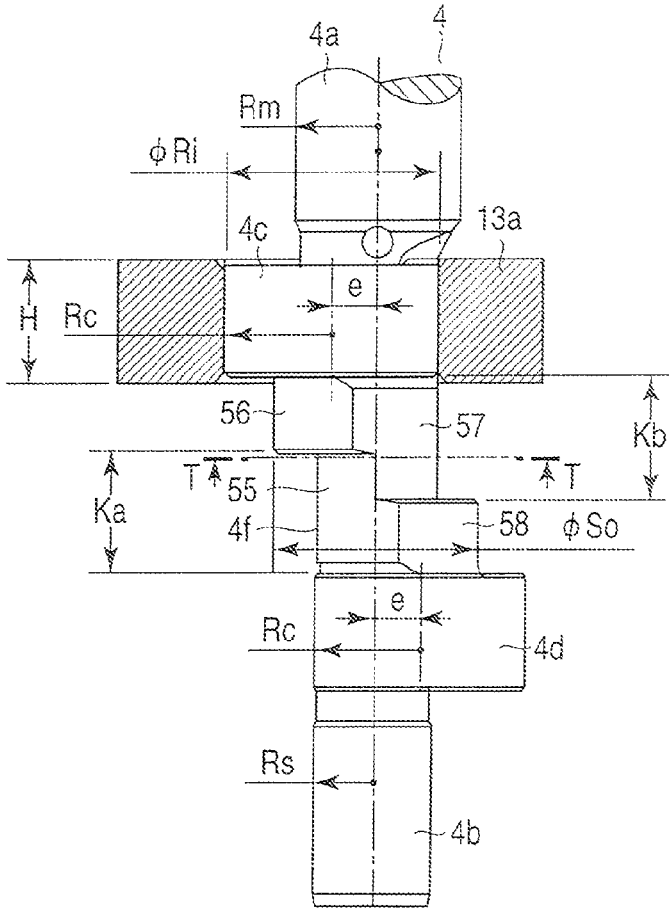
FIG. 7A is a sectional view showing the shapes, dimensions, and configurations of a first roller and a part of a rotary shaft of the multi-cylinder rotary compressor.
Figure 7B:
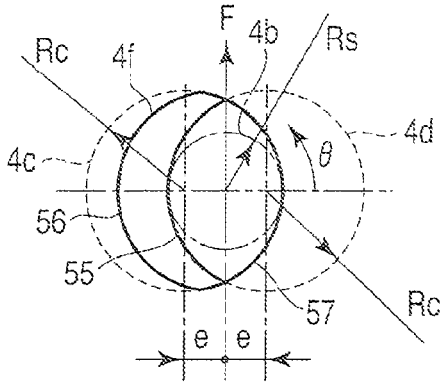
FIG. 7B is a sectional view of a part of the rotary shaft of the multi-cylinder rotary compressor taken along line T-T.

FIG. 7A is a diagram explaining the configuration of a part of the rotary shaft 4 of the compression mechanism 2, and the first roller 13*a*. FIG. 7B is a sectional view taken along line T-T in FIG. 7A.

Assuming the radius of the main shaft 4*a* constituting the rotary shaft 4 to be Rm, the radius of the countershaft 4*b* to be Rs, the radii of the first and second crankshafts 4*c* and 4*d* to be Rc, and the eccentricity of the crankshafts 4*c* and 4*d* to be e, the rotary shaft 4 is configured to have the formula (4).

$$Rc<Rm+e \tag{4}$$

The diameters of the first and second crankshafts 4*c* and 4*d*, and the diameters of the first and second cylinder chambers 14*a* and 14*b*, are reduced. As a result, friction loss is decreased, and compression efficiency is increased.

If the rotary shaft is configured to have the formula (5), the first roller 13*a* can be inserted from the end face of the countershaft 4*b*, and passed through the second crankshaft 4*d*. Finally, the first roller can be finally fitted to the first crankshaft 4*c*.

$$Rc\geqq Rs+e \tag{5}$$

The connecting part 4*f* connecting the first and second crankshafts 4*c* and 4*d* is shaped to have a cross section as indicted by a solid line in FIG. 7B (hatching is omitted).

In other words, the counter-eccentric side periphery of the second crankshaft 4*d* in the connecting part 4*f* has a A0-periphery 55, which is positioned on the same level as the outer periphery of the second crankshaft 4*d*, or inside the outer periphery, and has a radius greater than the radius Rs of the countershaft 4*b*, and a A1-periphery 56, which is formed between the A0-periphery 55 and the first crankshaft 4*c*, and positioned outside the counter-eccentric side periphery of the second crankshaft 4*d*.

The counter-eccentric side of the first crankshaft 4*c* in the connecting part 4*f* has a B0-periphery 57, which is positioned on the same level as the outer periphery of the first crankshaft 4*c*, or inside the outer periphery, and has a radius greater than the radius Rs of the countershaft 4*b*, and a B1-periphery 58, which is formed between the B0-periphery 57 and the second crankshaft 4*d*, and positioned outside the counter-eccentric side periphery of the first crankshaft 4*c*.

As described later (FIG. 8), the outermost diameter So of the peripheral, surfaces A1 56 and B1 58 is made smaller than the inside diameter Ri of the first roller 13*a* fitted to the first crankshaft 4*c*. Further, the axial intermediate part of the connecting part 4*f* is formed by the A0-periphery 55 and B0-periphery 57.

As the connecting part 4*f* is formed to have the above cross-sectional shape, the first roller 13*a* can be easily fitted to the first crankshaft 4*c* provided in the main shaft 4*a*, in the specifications adopting the formula (4), Rc<Rm+e, to improve the performance. The axial length of the connecting part 4*f* is made great, but the A1 and B1 peripheries 56 and 58 are provided to keep the rigidity of the connecting part 4*f* high, and prevent deformation.

In other words, the gas load F is maximum when θ is about 90° as already explained, but the connecting part 4*f* has a cross section thickest in the direction of θ=90° along the vertical center axis line, and the connecting part 4*f* is high in rigidity, and prevented from deformation by gas load.

Further, as the connection part 4*f* has A1 and B1 peripheries 56 and 58, the axial length of the part comprising the A1 and B1 peripheries 56 and 58, where the rigidity is the lowest, can be reduced, and deformation of the connecting part 4*f* caused by gas load is prevented.

Next, a detailed explanation will be give of the work of fitting the first roller 13*a* to the crankshaft 4*c* in this embodiment.

FIGS. 8A to 8E explain the work of fitting the first roller 13*a* to the first crankshaft 4*c*.

Figure 8A:
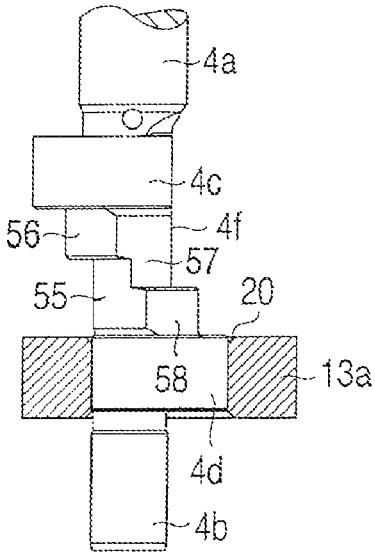
FIG. 8A is an explanatory diagram showing steps from insertion of a first roller of the multi-cylinder rotary compressor from a countershaft, to fitting the roller to a first crankshaft.
Figure 8B:
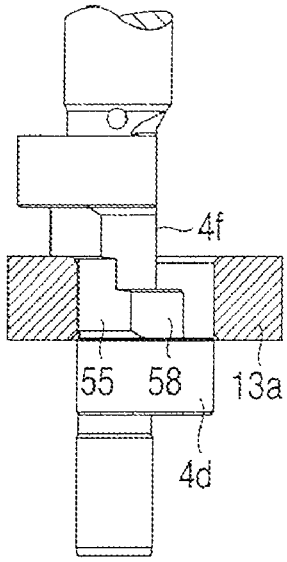
FIG. 8B is an explanatory diagram showing steps from insertion of a first roller of the multi-cylinder rotary compressor from a countershaft, to fitting the roller to a first crankshaft.

In FIG. 8A, the first roller 13*a* inserted from the end face of the countershaft 4*b* is moved and fitted to the second crankshaft 4*d*. As the bevel 20 is formed at the inside peripheral edge of the first roller 13*a*, the first roller can be smoothly fitted to the second crankshaft 4*d*. In this state, the first roller 13*a* is moved up and faced to the connecting part 4*e*.

In FIG. 8, the first roller is moved to the connecting part 4*f*. The A0-periphery 55 of the connecting part 4*f* is positioned on the same level as the outer periphery of the second crankshaft 4*d*, or inside the outer periphery, and the first roller can be easily moved from the second crankshaft 4*d* to the connecting part 4*f*.

Further, the first roller 13*a* is horizontally moved to the left in the drawing, so that the inside diameter part contacts the B1-periphery 58 of the connecting part 4*f*, and then moved upward.

Figure 8C:
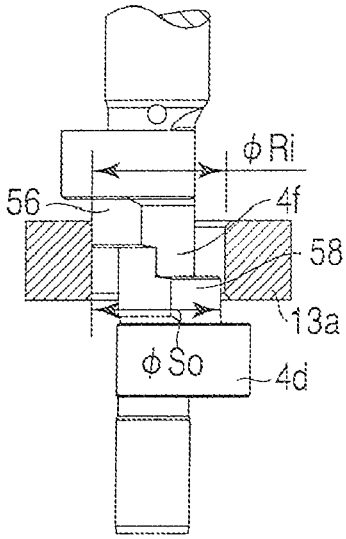
FIG. 8C is an explanatory diagram showing steps from insertion of a first roller of the multi-cylinder rotary compressor from a countershaft, to fitting the roller to a first crankshaft.

As shown in FIG. 8C, the inside diameter part of the first roller 13*a* is inserted into both peripheral surfaces A1 56 and B1 58. As already explained, the outermost diameter So of the A1 and B1 peripheries 56 and B1 58 is smaller than the inside diameter Ri of the first roller 13*a*, the inside diameter part of the first roller 13*a* can be smoothly moved up with respect to both peripheries 56 and 58.

Figure 8D:
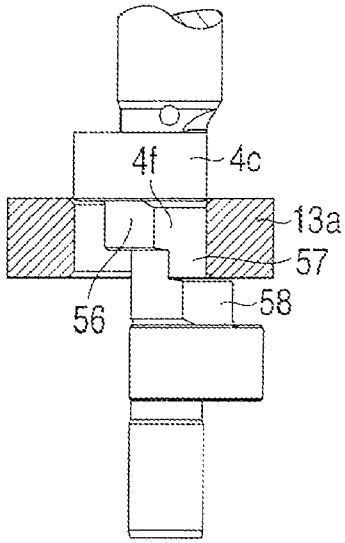
FIG. 8D is an explanatory diagram showing steps from insertion of a first roller of the multi-cylinder rotary compressor from a countershaft, to fitting the roller to a first crankshaft.
Figure 8E:
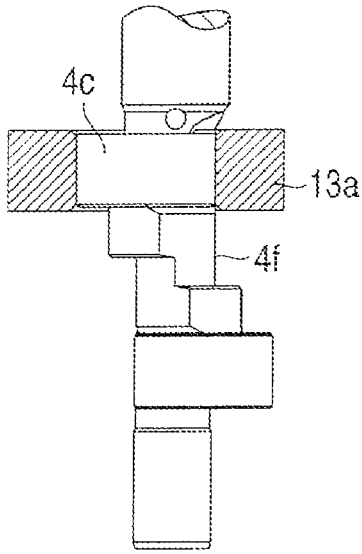
FIG. 8E is an explanatory diagram showing steps from insertion of a first roller of the multi-cylinder rotary compressor from a countershaft, to fitting the roller to a first crankshaft.

When the upper end face of the first roller 13*a* contacts the lower end face of the first crankshaft 4*c*, the first roller 13*a* is moved to the left in the drawing, and placed and slid on the upper end face of the B1-periphery 58. Then, as shown in FIG. 8D, the inside diameter part of the first roller 13*a* contacts the B0-periphery 57, and separates from the A1-periphery 56. In this state, the inside diameter part of the first roller 13*a* is correctly faced to the first crankshaft 4*c*. Then, the first roller 13*a* is moved immediately upward, and as shown in FIG. 8E, the inside diameter part of the first roller 3*a* is consequently fitted to the first crankshaft 4*c*.

As described above, in the connecting part 4*f* that is long in the axial direction, the A1-periphery 56 is formed between the A0-periphery 55 and first crankshaft 4*c*, and the B1-periphery 58 is formed between the B0-periphery 57 and second crankshaft 4*d*. Therefore, the rigidity of the connecting part 4*f* is increased, and the first roller 13*a* can be smoothly fitted to the first crankshaft 4*c* from the direction of the countershaft 4*b* through the connecting part 4*f*.

Figure 9:
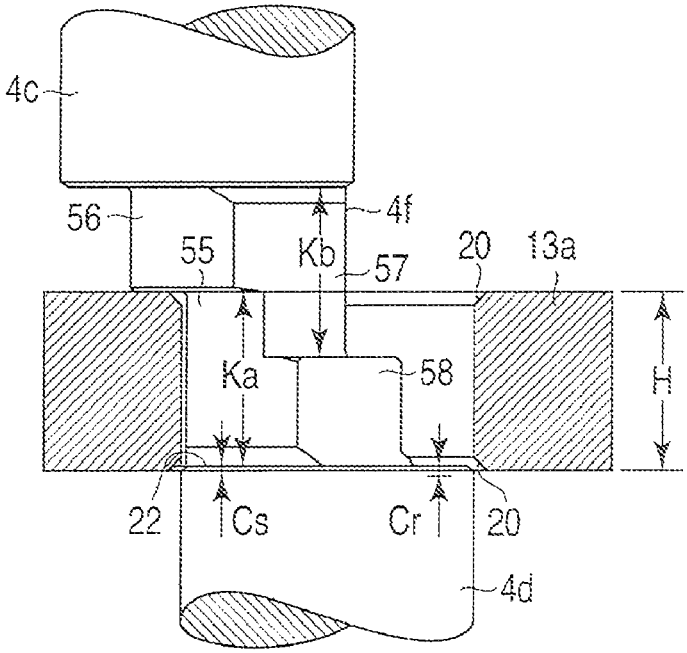
FIG. 9 is an explanatory diagram showing the shapes and dimensions of a connecting part and a first roller of the multi-cylinder rotary compressor in the state in which the first roller is being in the connecting part.

FIG. 9 shows the first roller 13*a* moved to the connecting part 4*f*. Here, the above configuration is adopted, and a bevel 22 is formed along the upper end face peripheral edge of the second crankshaft 4*d*.

Assuming the axial direction of the A0-periphery 55 to be Ka, the axial direction of the B0-periphery 57 to be Kb, the axial direction of the first roller 13*a* fitted to the first crankshaft 4*c* to be H, the axial direction of the bevel 20 formed at the inside peripheral edge of the first roller 13*a* to be Cr, and the axial length of the bevel 22 formed in the second crankshaft 4*d* to be Cs, the formulas (6) and (7) are established.

$$H>Ka\geqq H-Cr-Cs \tag{6}$$

$$H>Kb\geqq H-Cr-Cs \tag{7}$$

As described above, though the axial length of the connecting part 4*f* is very large compared with that in the first embodiment, the bevel 20 is formed in the first roller 13*a*, and the bevel 22 is formed in the second crankshaft 4*d*. This further facilitates fitting of the first roller 13*a* to the first crankshaft 4*c* from the direction of the end face of the countershaft 4*b* through the second crankshaft 4*d*.

The A-periphery 50 forming the connecting part 4*e* in the first embodiment and the A0-periphery 55 forming the connecting part 4*f* in the second embodiment, consist of a peripheral surface substantially coinciding with the center of the second crankshaft 4*d*. The B-periphery 51 forming the connecting part 4*e* in the first embodiment and the B0-periphery 57 forming the connecting part 4*f* in the second embodiment consist of a peripheral surface substantially coinciding with the center of the first crankshaft 4*c*.

Therefore, the arc shapes of the peripheral surfaces forming the connecting parts 4*e* and 4*f* can be machined coaxially with the first and second crankshafts 4*c* and 4*d*, and the manufacturability is improved.

The A1 and B1 peripheries 56 and 58 forming the connecting part 4*f* in the second embodiment consist of a peripheral surface substantially coinciding with the center of the rotary shaft 4. In other words, These peripheries can be machined coaxially with the main shaft 4*a* and countershaft 4*b*, and the manufacturability is improved.

Figure 10:
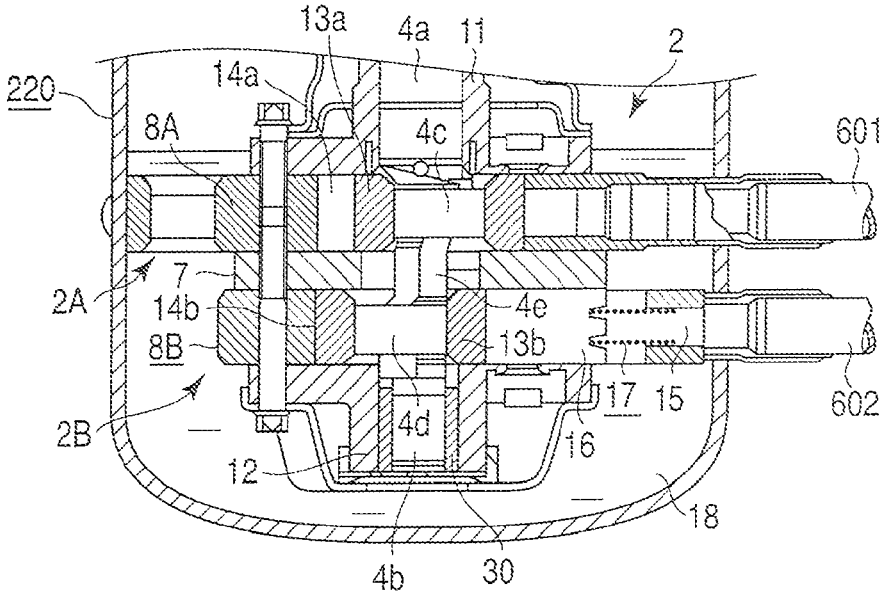
FIG. 10 is an outline sectional view of a multi-cylinder rotary compressor, omitted in some parts, according to modifications of the first and second embodiments of the invention.

FIG. 10 is a longitudinal sectional view of a multi-cylinder rotary compressor 220, omitted in some parts, as an example of a modification of the first and second embodiments.

In the drawing, except for a bush 30, the component parts are the same as those of the multi-cylinder compressor 200 explained in the first embodiment (FIG. 1). The same parts are denoted by the same number, and an explanation thereof is omitted. This rotary compressor is applicable as a modification of a not-shown multi-cylinder rotary compressor 210 explained in the second embodiment.

As the first roller 13*a* is inserted from the end face of the countershaft 4*b*, and fitted to the first crankshaft 4*c* through the second crankshaft 4*d* and connecting parts 4*e* and 4*f*, the radius of the countershaft 4*b* is set to Rs. Comparing with the main shaft 4*a*, the diameter of the countershaft 4*b* is small, the sliding radius for the countershaft 12 is small, and the reliability is not ensured.

In the multi-cylinder rotary compressor 220, the radius Rs of the countershaft 4*b* is unchanged, and the diameter of a pivot hole of a sub-bearing 12 pivotally fixing the countershaft 4*b* is enlarged by machining. The bush 30 is inserted into the clearance between the peripheral surface of the countershaft 4*b* and the peripheral surface of the enlarged pivot hole. Actually, the bush 30 is press fitted to the peripheral surface of the countershaft 4*b* in one piece, and the bush 30 is pivotally fixed to the sub-bearing 12.

For the convenience of fitting the first roller 13*a* from the direction of the countershaft 4*b*, even in the specifications in which the diameter of the countershaft 4*b* is reduced, the sliding radius in the sub-bearing 12 can be increased by using the bush 30, and the reliability is improved.

Figure 11:
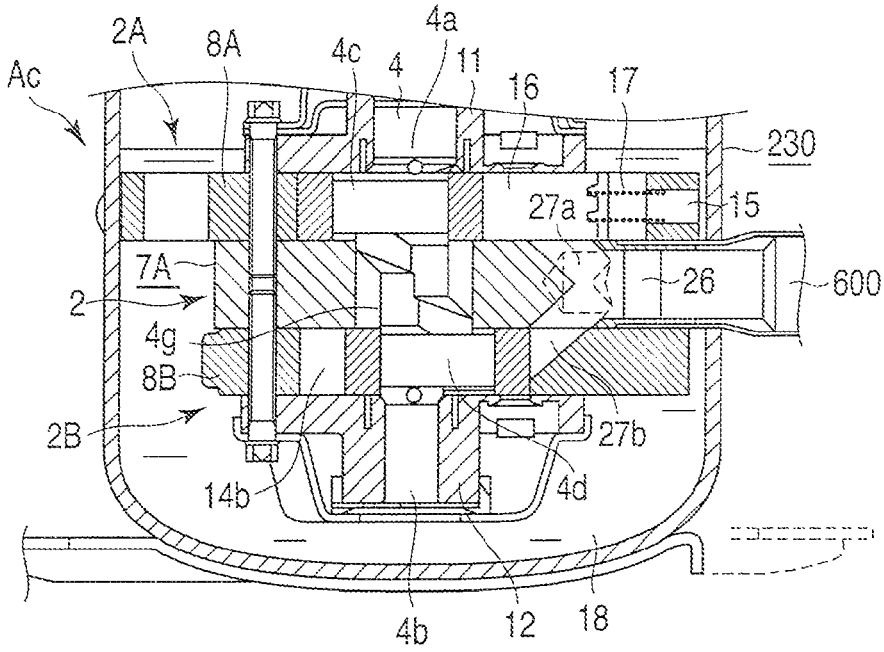
FIG. 11 is an outline sectional view of a multi-cylinder rotary compressor, omitted in some parts, according to a third embodiment of the invention.

FIG. 11 is a longitudinal sectional view of a multi-cylinder rotary compressor 230, omitted in some parts, according to a third embodiment.

Except for a connecting part 4*g* described later, the component parts are the same as those of the multi-cylinder compressor 210 explained in the second embodiment (FIG. 6). The same parts are denoted by the same number, and an explanation thereof is omitted. In the compressor 210, the blade chamber 15, blade 16, and spring member 17 are not shown in the drawing. In the compressor 230, these parts are shown in being fitted to the first cylinder 8A.

As in the multi-cylinder rotary compressor 210 in the second embodiment, comparing with the intermediate partition board 7 of the multi-cylinder rotary compressor 200 in the first embodiment, the thickness of the intermediate partition board 7A is increased, and the axial length of the connecting part 4*g* of the rotary shaft 4 provided oppositely to the intermediate partition board 7A is increased by the extent equivalent to the increased thickness of the intermediate partition board. Therefore, the rigidity of the connecting part 4*g* must be ensured for the gas load.

In the multi-cylinder rotary compressor 230 of this embodiment, the rigidity of the connecting part 4*g* is ensured as described below.

Figure 12A:
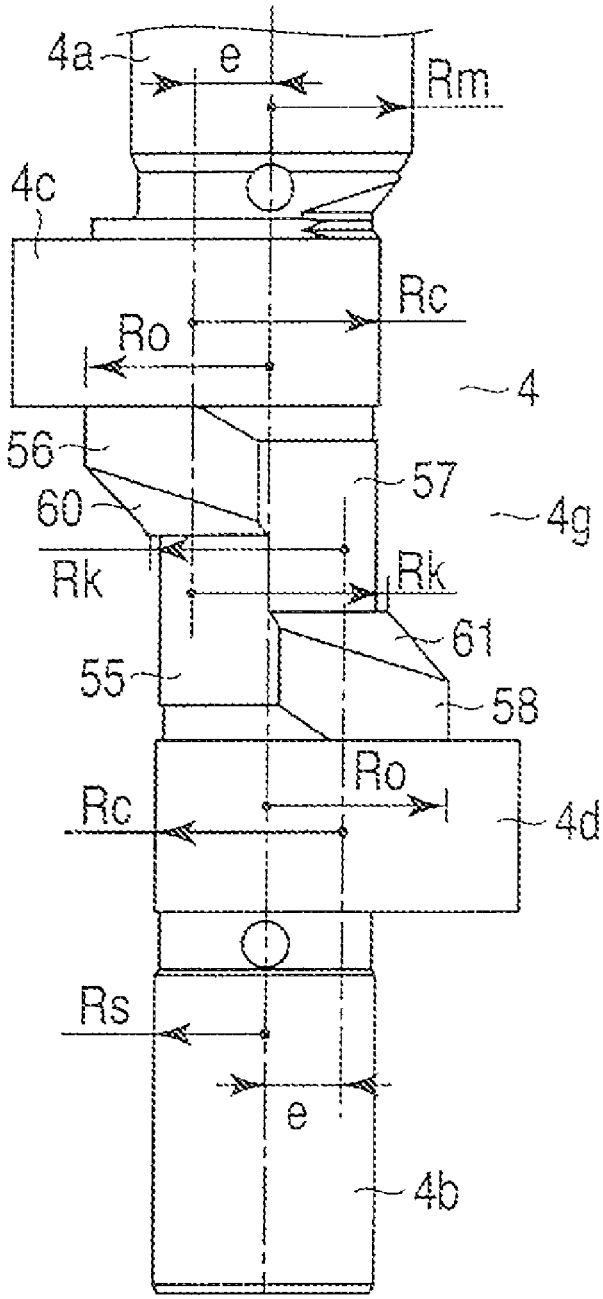
FIG. 12A is an explanatory diagram showing the shape and dimensions of a part of a rotary shaft used in a compression mechanism of the multi-cylinder rotary compressor.
Figure 12B:
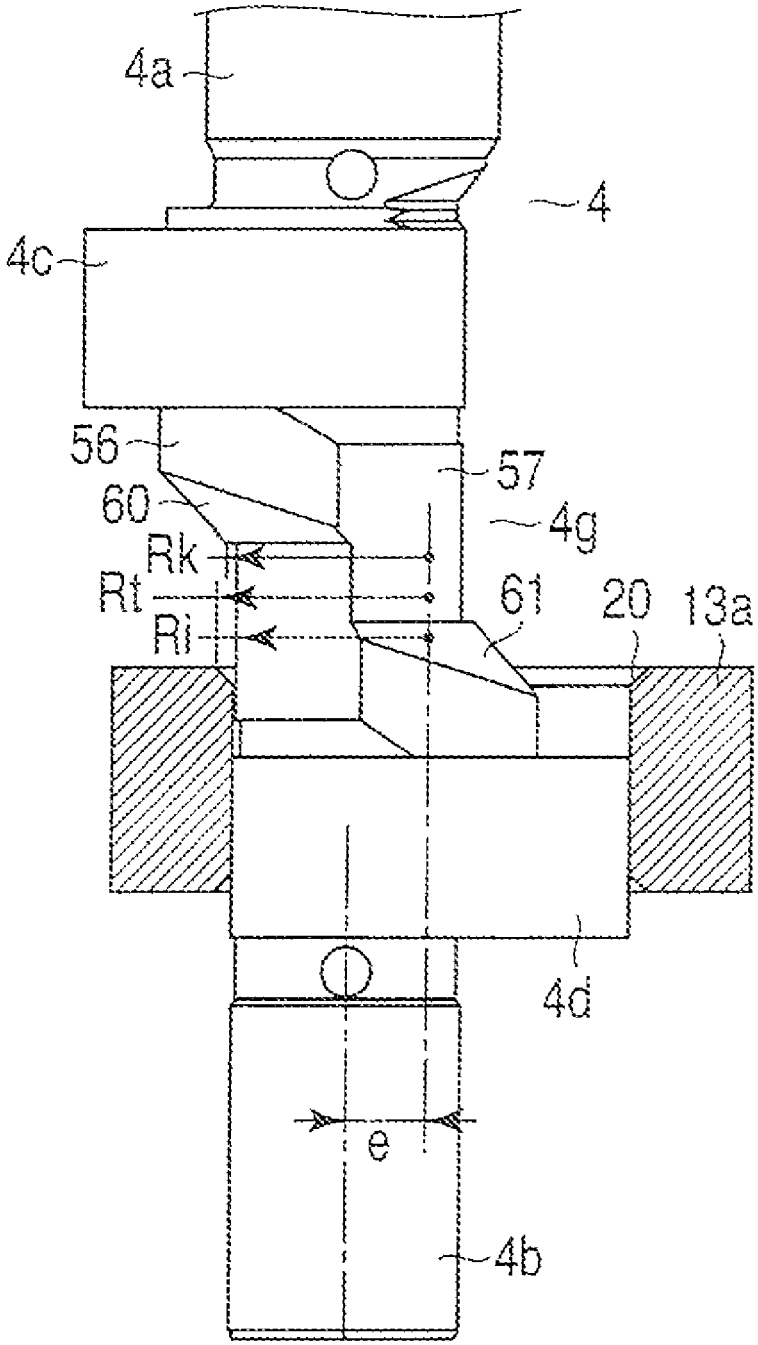
FIG. 12B is an explanatory diagram showing the shape and dimensions of a part of a rotary shaft used in a compression mechanism of the multi-cylinder rotary compressor.

FIG. 12A explains a part of the configuration of the rotary shaft 4 of the compression mechanism 2. FIG. 12B explains the configuration of the first roller 13 and connecting part 4*g*.

Assuming the radius of the main shaft 4*a* constituting the rotary shaft 4 to be Rm, the radius of the countershaft 4*b* to be Rs, the radii of the first and second crankshafts 4*c* and 4*d* to be Rc, and the eccentricity of the crankshafts 4*c* and 4*d* to be e, the formula (8) is established.

$$Rc<Rm+e \tag{8}$$

The diameters of the first and second crankshafts 4*c* and 4*d*, and the diameters of the first and second cylinder chambers 14*a* and 14*b*, are reduced. As a result, friction loss is decreased, and compression efficiency is increased.

If the formula (9) is established, the first roller 13*a* can be inserted from the end face of the countershaft 4*b*, and passed through the second crankshaft 4*d*. Therefore, the first roller is finally fitted to the first crankshaft 4*c*.

$$Rc \geqq Rs+e \quad (9)$$

In the connecting part 4*g* connecting the first and second crankshafts 4*c* and 4*d*, the counter-eccentric side periphery of the second crankshaft 4*d* has an A0-periphery 55, which is positioned on the same level as the outer periphery of the second crankshaft 4*d*, or inside the outer periphery, and has a radius greater than the radius Rs of the countershaft 4*b*, and an A1-periphery 56, which is formed between the A0-periphery 55 and the first crankshaft 4*c*, and positioned outside the counter-eccentric side periphery of the second crankshaft 4*d*.

Further, the part connecting the A0 and A1 peripheries 55 and 56 has a step caused by the different radii. The step is machined as described later, and a part of conical shape and a first inclined surface 60 having the same shape are formed.

In the connecting part 4*g*, the counter-eccentric side periphery of the first crankshaft 4*c* has a B0-periphery 57, which is positioned on the same level as the outer periphery of the first crankshaft 4*c*, or inside the outer periphery, and has a radius greater than the radius Rs of the countershaft 4*b*, and a B1-periphery 58, which is formed between the B0-periphery 57 and the second crankshaft 4*d*, and positioned outside the counter-eccentric side periphery of the first crankshaft 4*c*.

Further, the part connecting the B0 and B1 peripheries 57 and 58 has a step caused by the different radii. The step is machined as described later, and a part of conical shape and a second inclined surface 61 having the same shape are formed.

As described above, in the connecting part 4*g*, the counter-eccentric side periphery of the second crankshaft 4*d* has the A0-periphery 55, A1-periphery 56, and first inclined surface 60. The counter-eccentric side periphery of the first crankshaft 4*c* has the B0-periphery 57, B1-periphery 58, and second inclined surface 61.

As the connecting part 4*g* is configured as above, the first roller 13*a* can be easily fitted to the first crankshaft 4*c* provided in the main shaft 4*a*, in the specifications adopting the formula (8) $Rc<Rm+e$ to improve the performance.

The axial length of the connecting part 4*g* is set to be greater than the connecting part 4*e* of the multi-cylinder rotary compressor explained in the first embodiment, but the A1-periphery 56 and first inclined surface 60 are provided on the A0-periphery, and the B1-periphery 58 and second inclined surface 61 are provided on the B0-periphery 57.

Therefore, in the connecting part 4*g*, the step in the eccentric direction can be largely beveled without decreasing the thickness in the eccentric and rectangular directions, and the first roller 13*a* can be smoothly inserted from one direction of the rotary shaft 4 while maintaining the rigidity. Therefore, it is possible to provide a rigid and versatile rotary shaft 4.

The center position of the A0-periphery 55 substantially coincides with the center position of the second crankshaft 4*d*, and the center position of the B0-periphery 57 substantially coincides with the center position of the first crankshaft 4*c*. The center position of the A1-periphery 56 substantially coincides with the center position of the main shaft 4*a*, and the center position of the B1-periphery 58 substantially coincides with the center position of the countershaft 4*b*.

As the center positions of the main shaft 4*a* and countershaft 4*b* are the same, it can be said that the center position of the A1-periphery 56 substantially coincides with the center position of the counter shaft 4*b*, and the center position of the B1-periphery substantially coincides with the center position of the main shaft 4*a*.

The center position of the first inclined surface 60 substantially coincides with the center position of the first crankshaft 4*c*, and the center position of the second inclined surface 61 substantially coincides with the center position of the second crankshaft 4*d*.

Particularly, as shown in FIG. 12B, assuming the radius of the first roller 13*a* to be Ri, the inside radius of the end face of the first roller 13*a* provided with a bevel 20 at the inside edge to be Rt, and the minimum radius of the first inclined surface 60 to be Rk, the formula (10) is established.

$$Ri<Rk<Rt \quad (10)$$

When the first roller 13*a* is inserted from the direction of the countershaft 4*b* of the rotary shaft 4, the end face and interior of the first roller 13*a* are not damaged. The counter parts, the first cylinder 8A and first crankshaft 4*c* or the main bearing 11 and intermediate partition board 7A, are prevented from damaging, and the reliability is improved.

Figure 13:
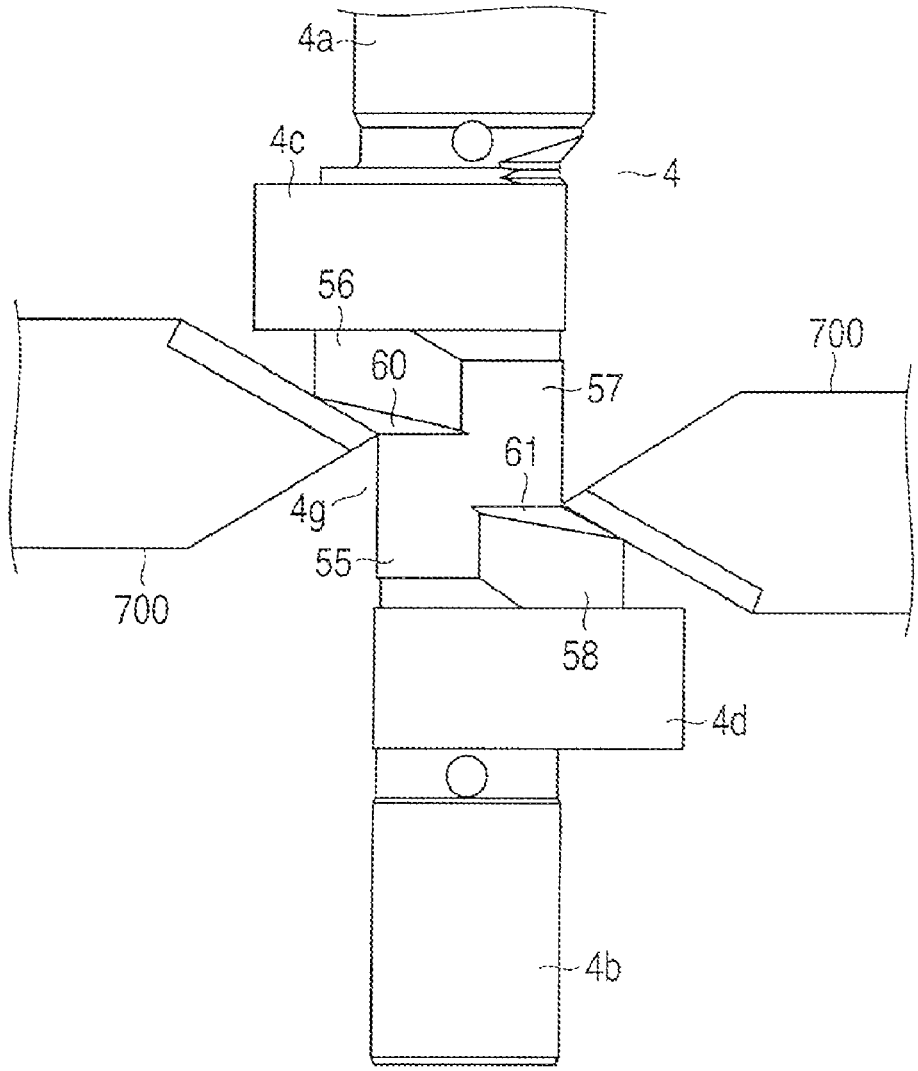
FIG. 13 is an explanatory diagram showing machining of first and second inclined surfaces of a rotary shaft of the multi-cylinder rotary compressor.

FIG. 13 shows the state of machining the first and second inclined surfaces 60 and 61, by using a cutting tool.

When cutting the first inclined surface 60, a cutting tool 700 is apart away from the first crankshaft 4*c*, and does not contact the first crankshaft 4*c*. Similarly, when cutting the second inclined surface 61, the cutting tool 700 is apart away from the second crankshaft 4*d*, and does not contact the second crankshaft 4*d*.

In other words, a part of the first inclined surface 60 extending to the outer periphery does not interfere with the first crankshaft 4*c*, and a part of the second inclined surface 61 extending to the outer periphery does not interfere with the second crankshaft 4*d*.

Therefore, when machining the first and second inclined surfaces 60 and 61, machining is possible by using the cutting tool 700 suitable for the inclination angle from the first machining step, without machining in several times by using cutting tools with different angles. As a result, the rotary shaft (crankshaft) 4, which does not interfere with the crankshafts 4*c* and 4*d*, can be easily manufactured at low cost.

By using the multi-cylinder rotary compressor 200, 210, 220 or 230 explained hereinbefore, it is possible to fit the first roller 13*a* to the first crankshaft 4*c* by inserting from direction of the countershaft 4*b*, and fit the second roller 13*a* to the second crankshaft 4*d* by inserting from the direction of the countershaft 4*b*, while ensuring the rigidity of the connecting parts 4*e*, 4*f* and 4*g* formed between the crankshafts 4*c* and 4*d*.

The rollers 13*a* and 13*b* can be smoothly fit with improved workability. In addition, the diameters of the crankshafts 4*c* and 4*d* can be reduced without reducing the diameter of the main shaft 4*a*. Therefore, the sliding loss of the crankshafts 4*c* and 4*d*, which occupies a large part of the sliding loss, can be reduced, noise and vibration can be reduced, and the reliability and compression performance can be improved.

By using the multi-cylinder rotary compressor 200, 210, 220 or 230 in refrigeration cycle equipment, the refrigeration cycle efficiency of the refrigeration cycle equipment can be improved.

The invention is not limited to the embodiments described hereinbefore. The invention may be embodied by modifying the constituent elements without departing from its spirit and essential characteristics in practical phases. The invention may be embodied in various specific forms by appropriately combining the constituent elements disclosed in the embodiments.

According to the invention, it is possible to provide a multi-cylinder rotary, in which a roller to be fitted to a crankshaft of a main shaft is inserted from the direction of the end face of a countershaft, sliding loss is reduced, dimensions are reduced, and compression performance and reliability are improved, and refrigeration cycle equipment which is improved in efficiency and reliability.

What is claimed is:

1. A multi-cylinder rotary compressor comprising:

a rotary shaft which comprises a main shaft pivotally fixed to a main bearing, a countershaft pivotally fixed to a sub-bearing, crankshafts provided eccentrically between the main shaft and countershaft, and fitted with rollers, and a connecting part connecting adjacent crankshafts; and cylinder chambers which house the crankshafts and rollers of the rotary shaft in being eccentrically rotatable, wherein formulas (1) and (2) are established, wherein Rm represents a radius of the main shaft, Rs represents a radius of the countershaft, Rc represents a radius of the crankshaft, and e represents an eccentricity of the crankshaft, $$Rc<Rm+e \quad (1)$$

$$Rc\geqq Rs+e \quad (2)$$

the connecting part which connects a first crankshaft provided in the main shaft and a second crankshaft provided in the countershaft, comprises:

an A-periphery, which is positioned on the same level as an outer periphery of the second crankshaft, or inside the outer periphery, on a counter-eccentric side periphery of the second crankshaft, and has a radius greater than the radius Rs of the countershaft; and a B-periphery, which is positioned on the same level as an outer periphery of the first crankshaft, or inside the outer periphery, on a counter-eccentric side periphery of the first crankshaft, and has a radius greater than the radius Rs of the countershaft, and a formula (3) is established, wherein L represents an axial length of the connecting part, H represents an axial length of the roller fitted to the first crankshaft, Cr represents an axial length of a bevel formed at an inside peripheral edge of the roller fitted to the first crankshaft, and Cs represents an axial length of a bevel formed in the second crankshaft, $$L+Cs\geqq H-Cr$$

$$L\geqq H-Cr-Cs$$

$$H>L\geqq H-Cr-Cs \quad (3).$$

2. The multi-cylinder rotary compressor according to claim 1, wherein the A periphery is formed on a peripheral surface, where center positions of the A periphery coincide with a center position of the second crankshaft, and the B periphery is formed on a peripheral surface, where center positions of the B periphery coincide with a center position of the first crankshaft.

3. Refrigeration cycle equipment comprising the multi-cylinder rotary compressor according to claim 1, a condenser, an expansion device, and an evaporator.

4. A multi-cylinder rotary compressor comprising:

a rotary shaft which comprises a main shaft pivotally fixed to a main bearing, a countershaft pivotally fixed to a sub-bearing, crankshafts provided eccentrically between the main shaft and countershaft, and fitted with rollers, and a connecting part connecting adjacent crankshafts; and cylinder chambers which house the crankshafts and rollers of the rotary shaft in being eccentrically rotatable, wherein formulas (4) and (5) are established, wherein Rm represents a radius of the main shaft of the rotary shaft, Rs represents a radius of the countershaft, Rc represents a radius of the crankshaft, and e represents an eccentricity of the crankshaft, $$Rc<Rm+e \quad (4)$$

$$Rc\geqq Rs+e \quad (5)$$

the connecting part which connects a first crankshaft provided in the main shaft and a second crankshaft provided in the countershaft, comprises:

an A0-periphery, which is positioned on the same level as an outer periphery of the second crankshaft, or inside the outer periphery, on a counter-eccentric side periphery of the second crankshaft, and has a radius greater than the radius Rs of the countershaft, and an A1-periphery, which is positioned outside the counter-eccentric side periphery of the second crankshaft, between the A0-periphery and the first crankshaft, and a B0-periphery, which is positioned on the same level as an outer periphery of the first crankshaft, or inside the outer periphery, on a counter-eccentric side periphery of the first crankshaft, and has a radius greater than the radius Rs of the countershaft, and a B1-periphery, which is positioned outside the counter-eccentric side periphery of the first crankshaft, between the B0-periphery and the second crankshaft, and an outermost diameter So of the A1 and B1 peripheral surfaces is smaller than an inside diameter of the roller fitted to the first crankshaft, an axial intermediate part of the connecting part is formed by the A0 and B0 peripheral surfaces, and formulas (6) and (7) are established, wherein Ka represents an axial length of the A0-periphery, Kb represents an axial length of the B0-periphery, H represents an axial length of the roller fitted to the first crankshaft, Cr represents an axial length of a bevel formed at an inside peripheral edge of a roller fitted to the first crankshaft, and Cs represents an axial length of a bevel formed in the second crankshaft, $$H>Ka\geqq H-Cr-Cs \quad (6)$$

$$H>Kb\geqq H-Cr-Cs \quad (7).$$

5. The multi-cylinder rotary compressor according to claim 4, wherein the A0 periphery is formed on a peripheral surface, where center positions of the A0 periphery substantially coincide with a center position of the second crankshaft, and the B0 periphery is formed on a peripheral surface, where center positions of the B0 periphery coincide with a center position of the first crankshaft.

6. The multi-cylinder rotary compressor according to claim 4, wherein the A1 and B1 peripheries are formed on a peripheral surface, which coincides with rotation centers of the main shaft and countershaft of the rotary shaft.

7. Refrigeration cycle equipment comprising the multi-cylinder rotary compressor according to claim 4, a condenser, an expansion device, and an evaporator.

8. A multi-cylinder rotary compressor comprising:

a rotary shaft which comprises a main shaft pivotally fixed to a main bearing, a countershaft pivotally fixed to a sub-bearing, crankshafts provided eccentrically between the main shaft and countershaft, and fitted with rollers, and a connecting part connecting adjacent crankshafts; and cylinder chambers which house the crankshafts and rollers of the rotary shaft in being eccentrically rotatable, wherein formulas (8) and (9) are established, wherein Rm represents a radius of the main shaft of the rotary shaft, Rs represents a radius of the countershaft, Rc represents a radius of the crankshaft, and e represents an eccentricity of the crankshaft, $$Rc<Rm+e \quad (8)$$

$$Rc \geqq Rs+e \quad (9)$$

the connecting part which connects a first crankshaft provided in the main shaft and a second crankshaft provided in the countershaft, comprises:

an A0-periphery, which is positioned on the same level as an outer periphery of the second crankshaft, or inside the outer periphery, on a counter-eccentric side periphery of the second crankshaft, and has a radius greater than the radius Rs of the countershaft, an A1-periphery, which is positioned outside the counter-eccentric side periphery of the second crankshaft, between the A0-periphery and the first crankshaft, and a first inclined surface formed in a step between the peripheral surfaces A0 and A1, and a B0-periphery, which is positioned on the same level as an outer periphery of the first crankshaft, or inside the outer periphery, on a counter-eccentric side periphery of the first crankshaft, and has a radius greater than the radius Rs of the countershaft, a B1-periphery, which is positioned outside the counter-eccentric side periphery of the first crankshaft, between the B0-periphery and the second crankshaft, and a second inclined surface formed in a step between the B0 and B1 peripheries.

9. The multi-cylinder rotary compressor according to claim 8, wherein a center position of the first inclined surface substantially coincides with a center position of the second crankshaft, and a center position of the second inclined surface coincides with a center position of the first crankshaft.

10. The multi-cylinder rotary compressor according to claim 8, wherein a part of the first inclined surface extending to the outer periphery does not interfere with the first crankshaft, and a part of the second inclined surface extending to the outer periphery does not interfere with the second crankshaft.

11. Refrigeration cycle equipment comprising the multi-cylinder rotary compressor according to claim 8, a condenser, an expansion device, and an evaporator.

* * * * *